US009802683B2

(12) United States Patent
Huang et al.

(10) Patent No.: US 9,802,683 B2
(45) **Date of Patent: *Oct. 31, 2017**

(54) SANDGLASS TYPE OCEAN ENGINEERING FLOATING STRUCTURE

(71) Applicant: DALIAN UNIVERSITY OF TECHNOLOGY, Dalian, Liaoning (CN)

(72) Inventors: Yi Huang, Liaoning (CN); Wenhua Wang, Liaoning (CN); Yuxin Yao, Liaoning (CN); Gang Liu, Liaoning (CN); Qi Zhang, Liaoning (CN); Hongxia Li, Liaoning (CN); Jingjie Chen, Liaoning (CN); Gangjun Zhai, Liaoning (CN)

(73) Assignee: DALIAN UNIVERSITY OF TECHNOLOGY, Dalian, Liaoning (CN)

( * ) Notice: Subject to any disclaimer, the term of this patent is extended or adjusted under 35 U.S.C. 154(b) by 17 days.

This patent is subject to a terminal disclaimer.

(21) Appl. No.: 14/416,511

(22) PCT Filed: May 3, 2013

(86) PCT No.: PCT/CN2013/075132

§ 371 (c)(1),
(2) Date: Jan. 22, 2015

(87) PCT Pub. No.: WO2014/059783

PCT Pub. Date: Apr. 24, 2014

(65) Prior Publication Data

US 2015/0175246 A1 Jun. 25, 2015

(30) Foreign Application Priority Data

Oct. 15, 2012 (CN) ..... 2012 1 0391074
Oct. 15, 2012 (CN) ..... 2012 2 0526277 U

(51) Int. Cl.
*B63B 35/44* (2006.01)
*B63B 3/20* (2006.01)
(Continued)

(52) U.S. Cl.
CPC ..... *B63B 35/4413* (2013.01); *B63B 3/20* (2013.01); *B63B 35/08* (2013.01); *B63B 2003/147* (2013.01)

(58) Field of Classification Search
CPC ..... B63B 35/4413; B63B 3/20; B63B 35/08; B63B 2003/147
(Continued)

(56) References Cited

U.S. PATENT DOCUMENTS 4,434,741 A 3/1984 Wright et al.
2009/0126616 A1* 5/2009 Srinivasan ..... B63B 35/44 114/264
(Continued)

FOREIGN PATENT DOCUMENTS

CN 101259872 A 9/2008
CN 202847986 U 4/2013
(Continued)

*Primary Examiner* — Anthony Wiest
(74) *Attorney, Agent, or Firm* — Novick, Kim & Lee, PLLC; Allen Xue

(57) ABSTRACT

A sandglass type ocean engineering floating structure is provided with an upper structural body shaped as a circular truncated cone or frustum and a lower structural body shaped as a regular circular truncated cone or regular frustum; under a combined state, the smaller bottom surface of the upper structural body is fixedly connected with the smaller bottom surface of the lower structural body to form a junction surface; the axis of the upper structural body and the axis of the lower structural body are positioned on the same straight line; the larger bottom of the upper structural body acts as an upper deck of the floating structure and the larger bottom of the lower structural body acts as a lower
(Continued)

plate underwater of the floating structure; the junction surface is a full-load waterplane of the floating structure.

6 Claims, 7 Drawing Sheets

(51) Int. Cl.
*B63B 3/14* (2006.01)
*B63B 35/08* (2006.01)

(58) Field of Classification Search
USPC ..... 114/256, 264
See application file for complete search history.

(56) References Cited

U.S. PATENT DOCUMENTS

| | | | | |
|---|---|---|---|---|
| 2011/0107951 | A1* | 5/2011 | Vandenworm ..... | B63B 1/041 114/125 |
| 2011/0174206 | A1 | 7/2011 | Kupersmith | |

FOREIGN PATENT DOCUMENTS

| | | | |
|---|---|---|---|
| CN | 202863728 | U | 4/2013 |
| CN | 103085946 | A | 5/2013 |
| CN | 103171743 | A | 6/2013 |
| WO | 2012005587 | A1 | 12/2012 |

* cited by examiner

SANDGLASS TYPE OCEAN ENGINEERING FLOATING STRUCTURE

TECHNICAL FIELD

The present invention relates to a ship (patent classification No: B63) or other waterborne vessels; a ship having ship-related equipment B63B and other waterborne vessels; and shipborne equipment B63B35/00 suitable for ships for special purposes or similar floating buildings having a floating structure B63B35/44, waterborne cabins, waterborne drilling platforms or waterborne workshops, for instance, which are loaded with oil-water separation equipment.

BACKGROUND ART

In the ocean engineering field, no matter from the points of economy of oil and gas production in shallow water areas and necessity of oilfield development in deepwater and superdeep water areas, corresponding scale of floating structures are required to be used. Besides, with the trends of multifunctional integration and development toward deep sea, the floating structures not only need enough hold capacity and deck area to bear oil and gas and equipment necessary to develop and produce, but need favorable movement performance to bear the combined action of severe environment loads from wind, wave and current in deep sea. The existing floating structures mainly include:

a semi-submersible floating structure is a multi-body small-waterplane mobile platform residing in that most floating body is submerged in water, comprises a platform body, pillars and a lower body or buoyancy tank, can be kept at a stable position basically after being moored and has relatively small movement amplitude under the environment load. However, owing to limited bearing capability and relatively small hold capacity space, the semi-submersible floating structure will limit storage of large-scale oil and gas and installation of essential equipment and produce the problem of uneven load distribution caused by occupancy to a large amount of deck area even though a method of configuring an oil tank is adopted. Therefore, it is very difficult for the traditional semi-submersible floating structure to realize integration of large-scale oil and gas production, storage, production, processing and transport.

Most of SPAR single-pillar floating structures are float bowls. The main body is of a single-cylinder structure and is perpendicularly suspended in water, thus being particularly suitable for deepwater operations. This kind of structures can be configured for deepwater oil and gas development and have movement stability and favorable safety, however, its shortages are that deep draught is greatly affected by ocean current, the structures are very difficult to haul and volumes for accommodating equipment and storing oil and gas and the deck area are very small, all of which limit the develop of multifunctional integration of such structures on different levels.

The traditional floating production storage and offloading system (FPSO for short) systems are generally transformed from old oil tankers or are barge-like FPSO systems designed and built in accordance with standard shipping ideas. At present, the techniques are relatively mature and can be used for exploitation, storage and production of large-scale oil and gas. However, those ship-like floating bodies have some limitations and shortages in the hydrodynamic performance as follows:

the natural heave period of the traditional ship-like FPSO is hardly away from a wave energy concentration area, and the heave movement amplitude is relatively large. Besides, the ship-like FPSO is very sensitive to the action direction of waves and has overlarge area of transverse motion in heading sea, thus resulting in relatively poor sway movement performance, all of which will seriously affect normal work of various equipments and instruments of FPSO as well as quality of produced raw oil and comfortable level of staff. The traditional ship-like FPSO has a 360-degree all-sided freely-rotating wind indicator effect due to a single-point mooring system equipped with an inner turret and a fluid connector, however, relatively serious yaw movement will not only affect normal running of many works, but will wear the inner turret and the fluid connector to make them frequent in need of repair and maintenance. Therefore, the production cost will be greatly increased due to self exorbitant prices of the inner turret and the fluid connector and existence of potential downtime.

Moreover, the cylindrical FPSO main body is of a floating cylindrical structure moored at the bottom of the sea. Such structure has large-scale storage and oil and gas production capabilities, is not sensitive to the directivity of wind, wave and current and has relatively small yaw movement amplitude, and whereas it has many shortages in terms of performances: large heave movement amplitude of the floating body, the vortex-induced vibration and the living space is too close to the working space by reason of relatively small deck area, which is not advantageous to separating a danger area from a non-danger area.

SUMMARY OF THE PRESENT INVENTION

The present invention has been devised to solve such technical problems, and an object thereof is to provide a sandglass type ocean engineering floating structure which has an upper structural body shaped as a circular truncated cone or frustum and a lower structural body shaped as a regular circular truncated cone or regular frustum; under a combined state, the smaller bottom surface of the upper structural body is fixedly connected with the smaller bottom surface of the lower structural body to form a junction surface; the axis of the upper structural body and the axis of the lower structural body are positioned on the same straight line, the larger bottom of the upper structural body acts as an upper deck of a floating structure and the larger bottom of the lower structural body acts as a lower plate underwater of the floating structure; the junction surface acts as a full-load waterplane of the floating structure. The main body of the structure, similar to a sandglass, takes the full-load waterplane as a horizontal cross section in the middle of the sandglass, and the upper structural body and the lower structural body have externally-expanded tilt angles respectively; the characteristic sizes of different horizontal cross sections of the structure along various directions are detailed, and different cross sections are round or regularly polygonal. An annular side plate configured to increase pitch/roll and heave damping of the floating body is connected to the outer surface of the lower structural body.

The upper structural body internally has a center compartment I which is identical in height with said upper structural body, and multiple watertight compartments surrounding the center compartment I are arranged around the center compartment I and are fixedly connected with the inner wall of a hull of the upper structural body and the outer wall of the center compartment I, respectively; and the lower structural body internally has a center compartment II which is identical in height with lower structural body, and multiple watertight compartments surrounding the center compartment II are arranged around the center compartment II and are fixedly connected with the inner wall of a hull of the lower structural body and the outer wall of the center compartment II, respectively.

The center compartment I and the center compartment II which are communicated with each other define a moonpool which intercommunicates with seawater.

Multiple support pillars are arranged outside the main body of the structure, wherein two ends of each support pillar are fixedly connected with the upper structural body and the lower structural body, respectively.

The axis of each support pillar and the axis of the structure are located on the same plane.

The multiple support pillars are uniform in length, wherein the fixed ends, positioned on the upper structural body, of the multiple support pillars are located on the same plane, and the fixed ends, positioned on the lower structural body, of the rest multiple support pillars are located on the same plane; the adjacent two support pillars constitute an isosceles triangle.

The upper structural body is defined as a circular truncated cone of which the generatrix is a curved line, a folding line or combined curved line and folding line, or a frustum of which the lateral edge is a curved line, a folding lines or a combination of curved line and folding line.

The lower structural body is defined as a regular circular truncated cone of which the generatrix is a curved line, a folding line or a combination of curved line and folding line, or a regular frustum of which the lateral edge is a curved line, a folding lines or combined curved line and folding line.

The junction surface is a waterplane of the floating structure. The floating structure is of a double-hull structure.

Due to the adoption of the technical scheme, the ocean engineering floating structure provided by the present invention is implemented by virtue of a simple structure; and the ocean engineering floating structure has a relatively large oil storage space compared with the traditional drilling and production platform and better movement performance compared with the traditional oil storage ship-like FPSO. Therefore, the ocean engineering floating structure provided by the present invention is beneficial to realizing integration of multiple functions, such as drilling, production, storage, production, processing and transportation of large-scale oil and gas in various sea areas and thus has better economic benefit.

BRIEF DESCRIPTION OF THE DRAWINGS

Accompanying drawings that need to be used in description of the embodiments or the existing technology will be briefly introduced below in order to illustrate the embodiments of the present invention and the technical solution of the existing technology, and it is apparent for those common skilled in the art that the accompany drawings described as below are just some embodiments of the present invention and other accompany drawings can be acquired on the basis of those accompany drawings on the premise of not paying creative work.

FIG. 2 is a schematic diagram of round or regularly polygonal horizontal cross section A-A, wherein

DETAILED DESCRIPTIONS OF THE PREFERRED EMBODIMENTS

Figure 1:
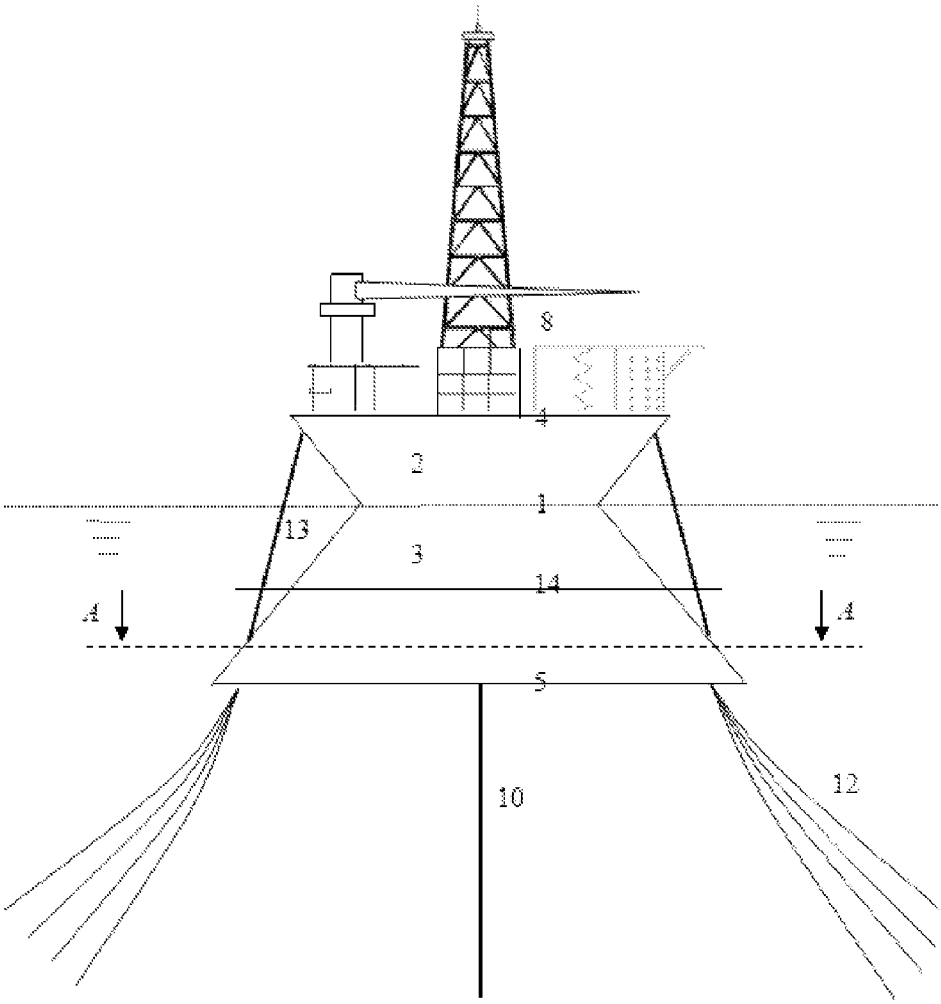
FIG. 1 is a schematic diagram of the sandglass type ocean engineering floating structure

The technical solution in the embodiments of the present invention is described clearly and completely in conjunction with the accompanying drawings in the embodiments of the present invention in order to make the objective, the technical solution and the advantages of the present invention clearer:

As shown in FIG. 1, an ocean engineering floating structure has a shape similar to a sandglass, that is, has an upper bottom surface and a lower bottom plate surface which are parallel to each other, which act as an upper deck 4 of the structure and a bottom plate 5 underwater, respectively, wherein the diameter of the middle part of the structure main body is remarkably smaller than the diameters of other parts, thus forming a structure similar to wasp waist or narrow waist.

As a preferable embodiment, the ocean engineering floating structure mainly comprises two parts, namely the upper structural body 2 shaped as a circular truncated cone or frustum and a lower structural body 3 shaped as a regular circular truncated cone or regular frustum; under a combined state, the upper structural body 2 is an inverted regular circular truncated cone or regular frustum, i.e., the upper bottom area is relatively large than the lower bottom area; on the contrary, the lower structural body 3 is an upright regular circular truncated cone or regular frustum, i.e., the upper bottom area is smaller than the lower bottom area. The lower bottom having a relatively small area of the upper structural body 2 is butt-jointed with the upper bottom having a relatively small area of the lower structural body 3 to each other to form a junction surface which is parallel to the deck and the lower bottom. When the structure is under water, the conjunction surface is a full-load waterplane 1 of the structure main body. Due to the existence of relatively small waterplane, externally-expanded and inclined underwater side surface and large-area bottom surface relative to the waterplane, the natural heaving period of the floating body is effectively controlled to be away from the spectrum high-energy hand, and the damping and added mass of pitch/roll and heave movements of the floating structure in the wind wave frequency band may be increased. Said floating structure has better movement stability relative to the traditional floating structures.

In practical production process, it may be not limited to a generating and processing method in which the upper and lower structural bodies are separated, and the upper and lower structural bodies can also be integrally molded according to actual situations.

In order to further enhance the movement stability of the floating structure in water, as a preferable embodiment, the outer surface of the lower structural body 3 is equipped with an annular side plate 14 which is horizontally configured generally that is, parallel to other planes of said structure, and in the meantime, the pitch angle of the annular side plate can be adjusted according to actual sea conditions of different sea areas. The annular side plate 14 structurally has a function similar to a heave plate and a bilge keel on a ship and may restrict the movement response of the floating body at the low-frequency surge frequency band. The present invention has extremely good pitch/roll and heave movement resistance, relatively strong adaptive capacity to extreme sea environments and very high work effectiveness and safety in conjunction with the shape of the structure main body.

Further, preferably, the present invention has a plurality of support pillars 13 arranged outside the structure main body in order to increase the self strength of the floating structure, and generally, the support pillars 13 are symmetrically arranged. Two ends of each support pillar 13 are fixedly connected with the upper structural body 2 and the lower structural body 3, respectively and the axis of each support pillar 13 and the axis of the structure are positioned on the same plane. Accordingly, the support pillars may play roles of enhancing the bearing capability of the deck and improving the bending strength of the floating body.

The shape and the fixing mode of the support pillars are not limited to this. As another preferable embodiment, the support pillars 13 are uniform in length, wherein the fixed ends, positioned on the upper structural body 2, of the support pillars 13 are positioned on the same plane, and the fixed ends, positioned on the lower structural body 3, of the support pillars 13 are positioned on the plane; the two adjacent support pillars 13 constitute an isosceles triangle.

Figure 2A:
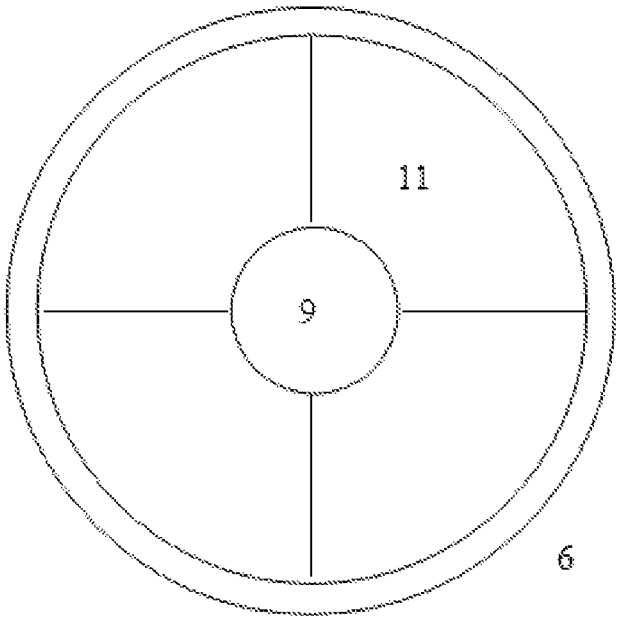
FIG. 2A is a schematic diagram of section A-A of the structure shaped as a circular truncated cone.
Figure 2B:
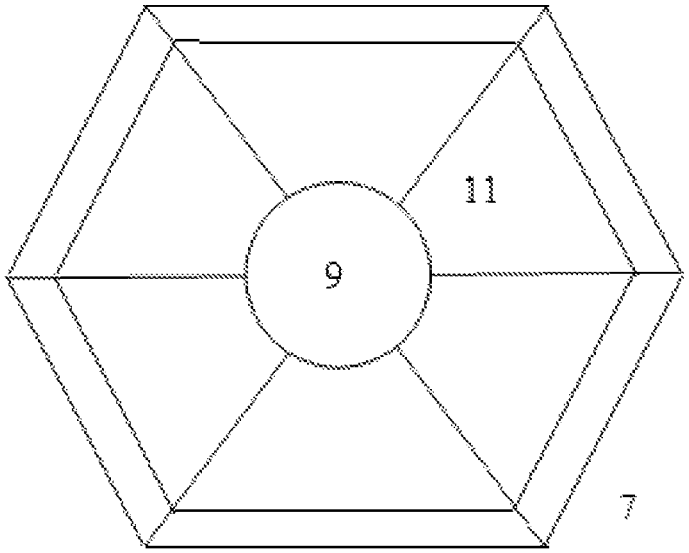
FIG. 2B is a schematic diagram of section A-A of a structure shaped as regular hexagonal pyramid.
Figure 3A:
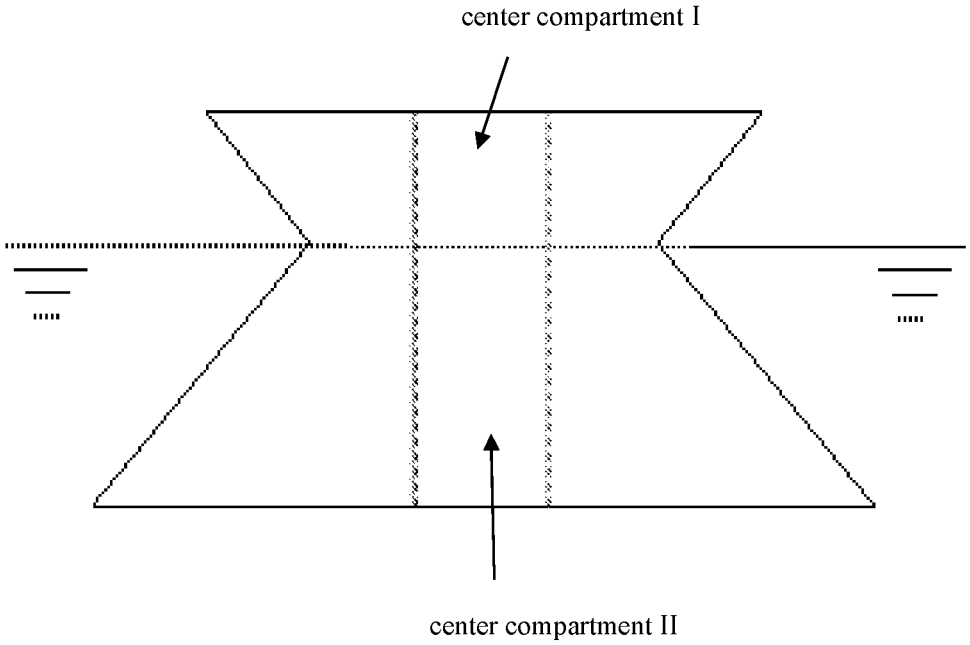
FIG. 3A, FIG. 3B, FIG. 3C and FIG. 3D are side views of main bodies of different shapes of floating structures.
Figure 3B:
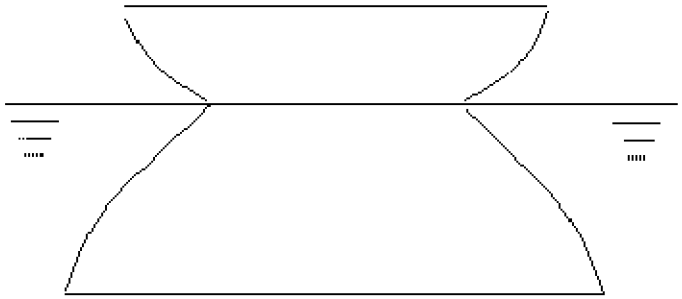
Figure 3C:
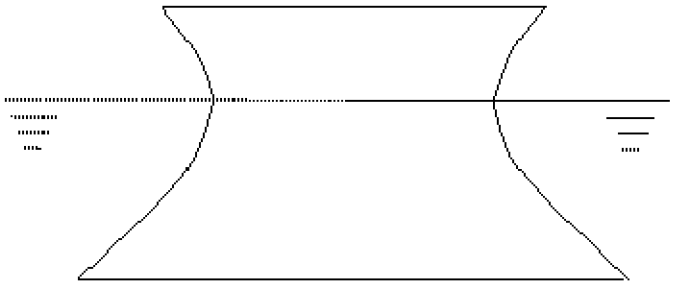
Figure 3D:
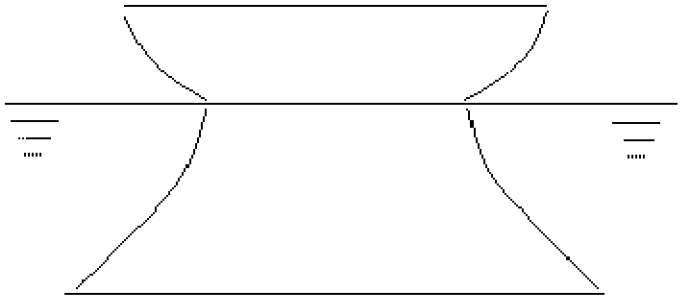

The ocean engineering floating structure is mainly manifested in shape of the hull and can be provided with multiple types of functional compartments internally so as to meet different requirements on different types of offshore operations. As a preferable embodiment, as can be seem from FIG. 2:

the upper structural body internally has a center compartment I which is identical in height with said upper structural body, and multiple watertight compartments or multifunctional compartments surrounding the center compartment I are arranged around the center compartment I. Preferably, the multiple watertight compartments are arranged axisymmetrically. The watertight compartments 11 are fixedly connected with the inner wall of the hull of the upper structural body 2 and the outer wall of the center compartment I, respectively; and these functional compartments provide support for the structure.

In the same way, the lower structural body 3 internally has a center compartment II which is identical in height with said lower structural body, and multiple watertight compartments 11 surrounding the center compartment II are arranged around the center compartment II, are fixedly connected with the inner wall of the hull of the lower structural body 3 and the outer wall of the center compartment II, respectively and provide support for the hull of the lower structural body 3.

Further, in order to be able to mount a drill bit, risers or other production operation equipment, preferably, the center compartment I intercommunicates with the center compartment II in the vertical direction to form a moonpool 9 penetrating through the whole structure so as to provide convenience for mounting related equipment. In the meantime, since the moonpool 9 and seawater are communicated, the stability of the structure in water can be further enhanced.

The shape of the upper structural body 2 is not limited to frustum or circular truncated cone, and other structures similar to frustum or circular truncated cone are available, which can be a circular truncated cone of which the generatrix is a curved line, a folding line or a composite linetype of the curved line and the folding line or a frustum of which the lateral edge is a curved line, a folding line or a composite linetype of the curved line and the folding line, both of which can achieve similar effects as well (refer to FIG. 3).

In the same way, similar to the upper structural body 2, the lower structural body 3 can be designed as a regular circular truncated cone of which the generatrix is a curved line, a folding line or combined curved line and folding line or a regular frustum of which the lateral edge is a curved line, a folding line or a combination of curved line and folding line. Experiments prove that all structures similar to the regular circular truncated cone or regular frustum have the advantages as described in the present invention.

Moreover, the present invention also has the following performance advantages:

An underwater part of the present invention adopts a lateral design having a certain externally-expanded tilt angle. On the basis of having enough oil reserve quantity and favorable seakeeping performance, the present invention, compared with SPAR and deep draught semi-submersible type, the novel floating body is relatively shallow in water draught, easy to maintain, migrate and tow, can be further used for shallow water works and has stronger applicability to applied sea areas.

The present invention has relatively small waterplane and relatively small vertical and horizontal characteristic lengths, thus being capable of reducing vertical and horizontal hogging or sagging bending load of the wave action on the structure. In addition, since the present invention has a hourglass-shaped structure small in the middle and large in two ends, the floating body has a relatively high middle section modulus in any direction, and therefore the structural strength is further increased, so that structure bending and fatigue stress can be positioned at a relatively low level.

The underwater part of the present invention adopts a lateral design having a certain externally-expanded tilt angle. The novel floating body, compared with a cylinder having same waterplane area and volume of displacement, has smaller underwater incident flow area. Furthermore, the externally-expanded side surface is beneficial to restricting generation of vortex-induced vibration. Therefore, under the same ocean current environment, the novel floating body will suffer relatively small flow load action.

The floating body of the present invention is shaped as central symmetry, so that the center compartments or the moonpool can be built in the center of the floating body very conveniently for laying pipelines directly leading to all liquid compartments, whereas no pipeline is needed any more in oil and water compartments, and thus the engineering design, construction and operation are greatly simplified and various raw materials, such as pipelines and cables can be saved. On the other hand, since the levels of similarity of various module structures of the novel floating body are high, it is very suitable to adopt a modularized construction technology, and thus the design and construction difficulties are reduced. Furthermore, the floating body can be segmented symmetrically according to the symmetry principle, the requirements of the main body on dock construction are reduced, and accordingly, a greater selection space is provided for owners.

The present invention adopts a lateral design having a certain externally-expanded tilt angle, which can increase the volumetric static moment of immersed and emerged wedges when the floating body inclines. Therefore, under the condition of meeting the initial stability and along with the increase of tilt angle, the restoring torque of the floating body is increased fast according to the lateral shape with the accompanying of relatively large extreme restoring torque and vanishing angle of stability. Moreover, the pitch/roll damping and added mass of the floating body can be greatly increased with combination of inclined lateral design and the annular side plate structure, and thus the natural period can be prolonged and the movement amplitude can be reduced. Hence, the novel floating structure can provide enough big stability of tilt angle without generating violent rolling when encountering stormy waves and thus has stability suitable for deep sea environment. On the other hand, the waterplane size and the inertia moment of the underwater floating body continuously increase along with the decrease of draught, and stability loss caused by decrease of displacement and height of center of buoyancy can be well remedied, and therefore, the novel floating body can effectively promote stabilities under different load conditions, such as full load and ballast load and avoid the stability loss caused by heave resonance movement of the cylindrical FPSO or SPAR platform.

The present invention adopts a structure having double bottoms and double hull board sides. This structure can enhance the hybrid rigidity of a main deck and a central shaft of the novel floating body, which is favorable for longitudinal strength of the structure. Moreover, the internal spaces of the double bottoms and the double hull board sides can act as water ballast tanks and also prevent damage and oil spillage of the floating body while playing a ballast effect, thus ensuring the safety and environmental friendliness of the production operation.

The present invention adopts an appearance design of a single revolving body, which overcomes the defects caused by twin hull appearance that the draught is very sensitive to load capacity change, the surface area is too large and the structure is relatively heavy, so that the mass of the main body of the novel floating body is relatively low, the effective load rate is increased, and further, the amount of steel and the cost of the structure are decreased.

The part above water of the present invention adopts a lateral design having a certain externally-expanded tilt angle. This appearance design having certain flare can decrease the wave run-up height of the novel floating body on the premise of excellent pitch/roll and heave movement performances, thus being capable of reducing the phenomenon of green water on deck appropriately. Furthermore, compared with a cylinder having the same waterplane area and volume, the inverted circular-truncated-cone-shaped floating body has relatively small windward area and relatively low stress point of action, and therefore, this novel floating body suffers relatively small wind load and wind heeling moment under the same sea wind conditions.

The present invention adopts a lateral design having a certain externally-expanded tilt angle. Therefore, when the sea ice acts on the side surface of the inclined floating body, traditional extrusion damage is changed into bending damage having relatively weak strength, and thus the ice load acting on the structure can be greatly decreased, and accordingly, the novel floating body has more excellent ice resistance and can be applicable to frozen sea areas.

Figure 4A:
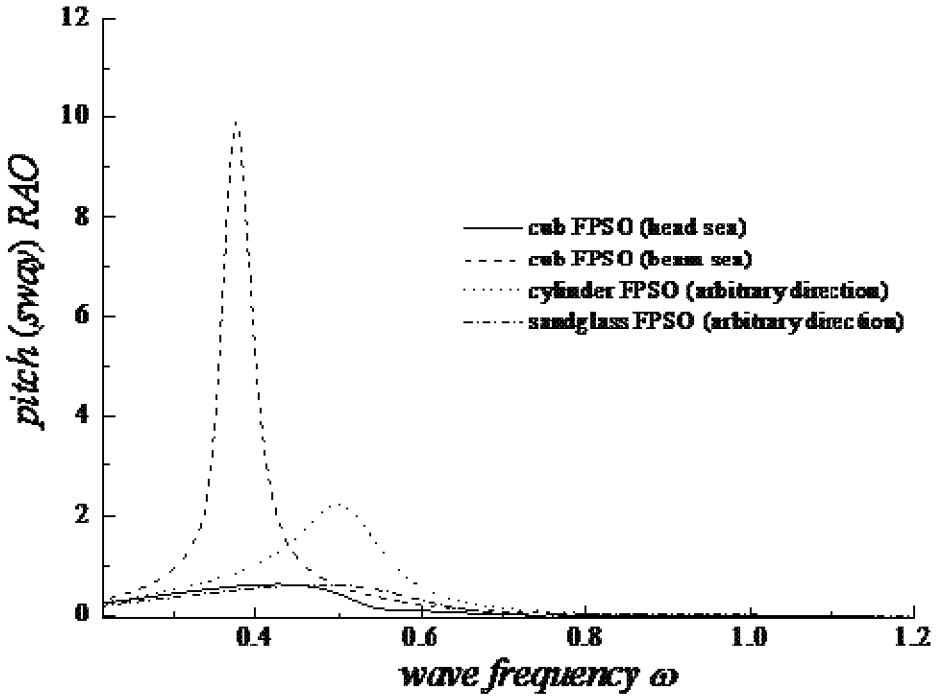
FIGS. 4A and 4B are comparative schematic diagrams of hydrodynamic performances of various types of FPSO; and the full-load waterplane 1, the upper structural body 2, the lower structural body 3, the upper deck 4, the bottom plate 5, the round horizontal cross section 6, the regularly polygonal horizontal cross section 7, equipment necessary to drilling or production operation 8, the moonpool 9, the risers 10, the watertight compartments 11, the multi-point mooring system 12, the support pillars 13 and the annular side plate 14 are displayed in drawings.
Figure 4B:
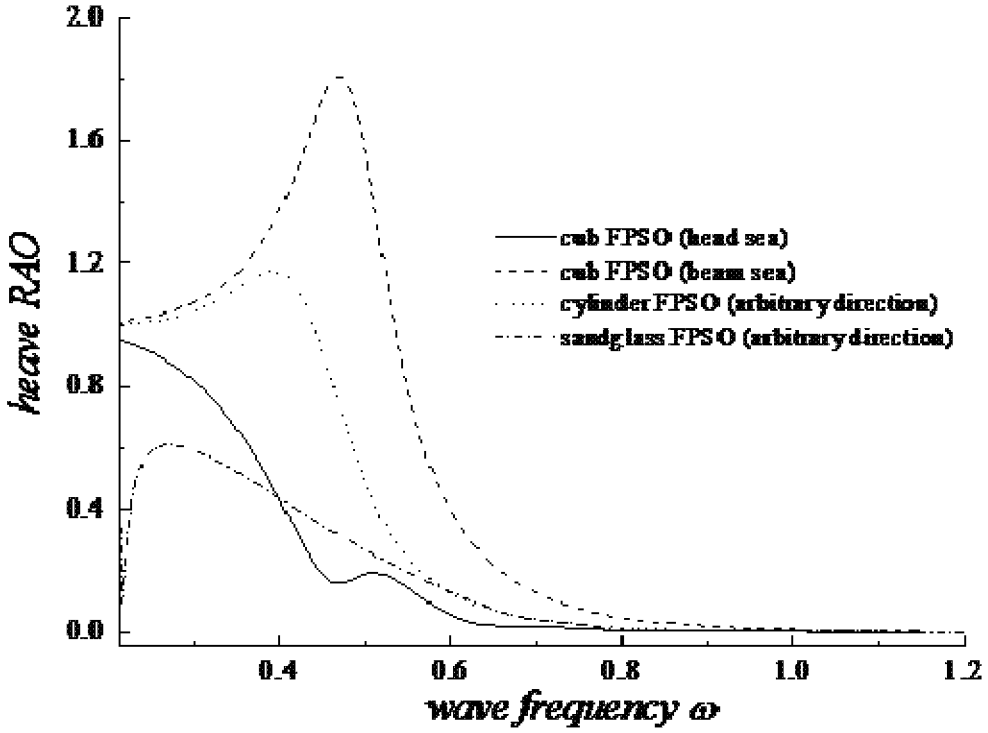

Here, in order to illustrate favorable movement performance advantage of a sandglass type ocean engineering floating structure as described in the present invention more intuitively, and hydrodynamic performances of the butt-jointed circular-truncated-cone-shaped sandglass-type FPSO (namely the upper structural body and the lower structural body as described are circular truncated cones), and a traditional rectangular barge FPSO and a cylindrical drum FPSO, which have the same functions (load capacity, volume of the floating body and the area of the upper deck) are compared and analyzed, and now, high-frequency movement performances (pitch, roll and heave) of various FPSO, which are calculated according to a verified general potential flow boundary element theory at present are represented by FIG. 4A and FIG. 4B, with a major focus on wind wave frequency band 0.209-6.28 (1-30 s) having relatively high energy.

As can be seen from the figures, compared with a barge-type FPSO, the novel FPSO has greatly promoted heaving and rolling movement performances when encountering the waves transversely, which are basically similar to the heave and pitch performances when encountering waves longitudinally. Furthermore, the pitch/roll and heave movement performances of the novel FPSO are greatly superior to those of the cylindrical drum FPSO. Therefore, it is indicated that the water dynamic performance of FPSO can be greatly improved due to the unique appearance design of the present invention.

In FIG. 4A and FIG. 4B, cub represents a rectangular barge FPSO model (head sea represents longitudinal motion in heading sea and beam sea represents transverse motion in heading sea), cylinder represents a cylindrical drum FPSO model, sandglass FPSO represents the butt-jointed circular-truncated-cone-shaped ocean engineering floating structure as described in the present invention. Besides, six degrees of freedom movement are surge, sway, heave, pitch, roll and yaw.

As stated above, the preferable embodiments abovementioned of the present invention are described, however, the present invention is not limited to these embodiments specifically disclosed, equivalent replacement or change, made by any technical personnel skilled in the art disclosed in the present invention in accordance to the technical solution and inventive concept of the present invention, should fall into the protection scope of the present invention.

The invention claimed is:

1. A sandglass type ocean engineering floating structure, comprising:

an upper structural body in shape of a circular truncated cone or frustum; and a lower structural body in shape of a regular circular truncated cone or regular frustum, wherein the upper structural body and the lower structure body are connected through their respective smaller bases at a junction plane, and an axis of the upper structural body and an axis of the lower structural body are aligned in a same straight line, wherein the upper structural body comprises an upper hull, a center compartment I disposed inside the upper hull that has a same height as that of said upper structural body, and a plurality of watertight compartments disposed between the upper hull and the center compartment I, wherein the lower structural body comprises a lower hull, a center compartment II that has a same height as that of said lower structural body, and a plurality of watertight compartments disposed between the lower hull and the center compartment II, wherein a larger base of the upper structural body serves as a deck and a larger base of the lower structural body serves as a bottom of the floating structure, and wherein the floating structure has a shape of a sandglass and horizontal cross sections of the floating structure are circular or polygonal;

wherein the center compartment I and the center compartment II are connected to form a through hole extending vertically through the floating structure from the larger base of the upper structural body and the larger base of the lower structural body, wherein the sandglass type ocean engineering floating structure further comprises a plurality of support pillars that are disposed about an exterior surface of the floating structure, wherein an upper end of a support pillar is fixedly attached to the upper structure body at an upper attach point and a lower end of the support pillar is fixedly attached to the lower structural body at a lower attached point, and each individual support pillar and the axis of the floating structure are located in a same plane.

2. The sandglass type ocean engineering floating structure according to claim 1, further comprising: an annular side plate attached to an outer surface of the lower structural body.

3. The sandglass type ocean engineering floating structure according to claim 1, wherein all of the plurality of support pillars have a same length, and all upper attach points are located in an upper plane and all lower attach points are located in a lower plane, wherein two adjacent support pillars form two sides in an isosceles triangle.

4. The sandglass type ocean engineering floating structure according to claim 1, wherein the upper structural body is a circular truncated cone of which a generatrix is a curved line, a folding line, or a combination of curved line and folding line, or a frustum of which a lateral edge is a curved line, a folding lines, or combined curved line and folding line.

5. The sandglass type ocean engineering floating structure according to claim 1, wherein the lower structural body is defined as a regular circular truncated cone of which a generatrix is a curved line, a folding line, or combination of curved line and folding line, or a regular frustum of which a lateral edge is a curved line, a folding lines, or combined curved line and folding line.

6. The sandglass type ocean engineering floating structure according to claim 1, wherein the floating structure has a double-hull structure.

* * * * *